US007718593B2

(12) United States Patent
Micciche et al.

(10) Patent No.: US 7,718,593 B2
(45) Date of Patent: May 18, 2010

(54) STABLE, LOW-FOAMING, PEROXIDE STEAM CLEANING COMPOSITIONS AND METHOD OF PREDICTING FOAMING IN STEAM CLEANING COMPOSITIONS

(75) Inventors: Robert P. Micciche, Somerset, NJ (US); Benjamin C. Ramirez, Jr., Englewood, NJ (US); Anne Tashjian, River Edge, NJ (US)

(73) Assignee: Bissell Homecare, Inc., Grand Rapids, MI (US)

( * ) Notice: Subject to any disclaimer, the term of this patent is extended or adjusted under 35 U.S.C. 154(b) by 601 days.

(21) Appl. No.: 11/030,867

(22) Filed: Jan. 7, 2005

(65) Prior Publication Data

US 2005/0181966 A1 Aug. 18, 2005

Related U.S. Application Data

(60) Provisional application No. 60/535,434, filed on Jan. 9, 2004.

(51) Int. Cl.
*C11D 1/66* (2006.01)
*C11D 1/90* (2006.01)
*C11D 1/92* (2006.01)
*C11D 9/42* (2006.01)

(52) U.S. Cl. ..... 510/278; 510/276; 510/281; 510/286; 510/288; 510/302; 510/309; 510/367; 510/375

(58) Field of Classification Search ..... 510/276, 510/278, 281, 286, 288, 302, 309, 367, 375
See application file for complete search history.

(56) References Cited

U.S. PATENT DOCUMENTS

| | | | | |
|---|---|---|---|---|
| 6,475,970 | B1 * | 11/2002 | Del Duca et al. | 510/375 |
| 6,867,174 | B2 * | 3/2005 | Ramirez et al. | 510/279 |
| 2002/0059944 | A1 * | 5/2002 | Masotti et al. | 134/21 |

* cited by examiner

*Primary Examiner*—Brian P Mruk
(74) *Attorney, Agent, or Firm*—Ohlandt, Greeley, Ruggiero & Perle, LLP

(57) ABSTRACT

There is provided an aqueous low-foaming cleaning composition comprising peroxygen compound and a surfactant system, wherein the composition has a MR foam value of about less than 16. The composition is stable and suitable for use in a steam cleaning machine. There is also provided a method for predicting foam generation in steam cleaning compositions comprising the steps of mixing the composition.

30 Claims, No Drawings

STABLE, LOW-FOAMING, PEROXIDE STEAM CLEANING COMPOSITIONS AND METHOD OF PREDICTING FOAMING IN STEAM CLEANING COMPOSITIONS

RELATED APPLICATION

This application claims priority from the U.S. provisional patent application bearing application Ser. No. 60/535,434, filed on Jan. 9, 2004.

BACKGROUND OF THE INVENTION

1. Field of the Invention

The present invention relates to steam cleaning compositions. More particularly, the present invention relates to stable, low-foaming steam cleaning compositions for use in cleaning carpets, fabrics and other inanimate surfaces.

2. Description of the Related Art

Fabric and carpet fibers may become soiled or stained upon contact with water and proteinaceous materials, particulate matter, oily/greasy type soils, oxidizable materials, and various other materials. Cleaning compositions are formulated for use on fabrics and carpets.

An important property of cleaning compositions is their propensity to foam. In some situations, a high level of foam is desirable as an indicator to consumers that the product is still working as a cleaner. An example of this would be in hand dishwashing. A lack of foam might be a signal to the consumer to add more products to provide additional cleaning.

However, in other areas of product use, low to negligible levels of foam generation is required. In areas of use where the cleaning product is subjected to high levels of mechanical agitation such as in steam machine carpet cleaning, heavy foam generation results in foam filling the machine and possibly flowing out of its containment. There is also the potential for the foam to seep into machine parts and damage the machine or, at the very least, cause a great deal of inconvenience for the consumer. Furthermore, compositions that are low foaming under other conditions may produce greater, unacceptable levels of foam under the conditions of typical steam cleaning machines.

Today's steam machine cleaning formulations typically are formulated as concentrates, which are then diluted for use. Certain popular machines actually take the detergent concentrate and make the dilution according to preset conditions programmed by the manufacturer. In such cases, it is especially important to have a low foaming product since high settings on the machine will typically be above the recommended product dosage level. Low foaming products help aid in machine safety as well as consumer satisfaction.

Formulating low foaming compositions that are effective in cleaning poses difficulties for the formulator. For example, many commonly used surfactants, particularly certain anionic and amphoteric surfactants, typically are high foam generating surfactants. One method of reducing foam in cleaning compositions is the inclusion of silicone compounds as defoaming agents. However, typical silicone compounds used as defoaming agents could potentially promote resoiling of the carpet or fabric. Further, under typical steam cleaning conditions, the silicone in the cleaning composition may destabilize and separate out of solution leading to the potential coating of machine components with silicone material.

The development of a quick, reliable and easy-to-use predictor test method for foam generation is essential to the development of suitable formulations for today's steam machines, both in terms of machine safety and consumer convenience. Additionally, a good predictor test method will save detergent formulators valuable time and cost in the testing. While outside laboratory tests that use the steam machines of choice can be used as a final method of product acceptability, the service can prove costly and time consuming if used as a screening method for all prototypes.

Of the various dynamic and static test methodologies currently available, the Ross-Miles Method is the most widely used, ASTM D 1173-53 and B. M. Milwidsky and D. M. Gabriel "Detergent Analysis, A Handbook For Cost-Effective Quality Control", 1994 (Micelle Press), pp. 42-43, 175-176. Unfortunately, at the dilution levels typically employed by this method (1% or 0.1%) it was found that false positive results could be obtained. For example, the foam profile of a prototype formulation could be judged low and acceptable in the lab using the Ross-Miles Method. However, when the same prototype formulation is sent for outside lab testing using actual steam machines, the agitation and product concentration employed resulted in unacceptable results. Based on these types of misleading results, a more reliable lab test method to predict foaming profiles in steam cleaning machines is required.

In addition to providing acceptable cleaning performance with no consumer downsides such as too high a foam level or a propensity for resoiling, cleaning compositions must be stable in storage. Furthermore, there is great consumer demand for the inclusion of peroxygen compounds in cleaning compositions, particularly in steam machine cleaning compositions. Peroxygen compounds increase the cleaning range of typical cleaning compositions. However, peroxygen compound containing compositions pose a great challenge for composition formulators, especially in the realm of stability.

A typical consumer may store a cleaning product for many months before use under less than ideal conditions. During storage, the components of the composition ideally should not separate from each other or, if they do, simple shaking the container should result in a completely homogeneous solution. A homogeneous solution during use is necessary for a composition to remain fully effective. The problem of compositional instability is further exacerbated when a peroxygen compound is incorporated into the formulation. Peroxygen compounds easily degrade and their effectiveness as decolorizing and cleaning agents is quickly reduced upon degradation. Furthermore, degradation of a peroxygen compound generates gases that can cause swelling and potential bursting, of the package in which the cleaning composition is provided.

Another concern that is often forgotten is the potential aggressiveness of a peroxygen compound containing composition and its effects (both long term and short term) on the various machine components that are exposed to the cleaning solution under the typical use conditions. Thus, compositions containing these types of materials must not only be stable, but also safe to use by consumers on their carpets and safe to use in various steam machines.

Thus, a low-foaming, stable steam cleaning composition that has a peroxygen compound that is effective for cleaning carpets and fabrics, and that is safe for use on fabrics and carpets, and safe for use in steam cleaning machines, is required. However, no current steam cleaning composition having a peroxygen compound, let alone one that is low-foaming, stable, effective, and safe for use is known. Accordingly, a low-foaming, stable, peroxygen compound containing steam cleaning composition that is effective and safe for cleaning carpets and use in steam cleaning machines is provided. Further, an inexpensive lab test for predicting and more closely simulating the foam profile of a steam cleaning composition in actual steam machines is also provided.

SUMMARY OF THE INVENTION

It is an object of the present invention to provide a stable, low-foaming steam cleaning composition.

It is also an object of the present invention to provide such a composition that is effective and safe for use in cleaning carpets and fabrics.

It is another object of the present invention to provide such a composition that includes a peroxygen compound and a surfactant system.

It is a further object of the present invention to provide such a composition in which all ingredients are selected such that all are compatible and form a stable, non-turbid solution.

It is a still further object of the present invention to provide a method of predicting foam generation in steam cleaning compositions.

To accomplish the foregoing objects and advantages, the present invention, in brief summary, is a stable, low-foaming steam cleaning composition effective for cleaning carpets and fabrics and safe for use in steam cleaning machines. The composition comprises peroxygen compound and surfactant. Also the present invention provides a method for predicting foam generation in a steam cleaning composition.

DETAILED DESCRIPTION OF THE INVENTION

The present invention provides an aqueous cleaning composition having peroxygen compound and a surfactant system. The compositions of the present invention are stable and low foaming. The compositions of the present invention are effective and safe for use in cleaning carpets and fabrics with a steam cleaning machine.

The compositions of the present invention include from about 0.1 percent by weight (wt %) to about 6 wt %, preferably from about 0.5 wt % to about 4 wt %, and most preferably from about 0.5 wt % to about 2 wt %, of a peroxygen compound. Peroxygen compounds suitable for use in the present invention include hydrogen peroxide and T-butyl hydroperoxide. The use of hydrogen peroxide is preferred. While it is conventional in the art to use an industrial grade hydrogen peroxide in the formation of cleaning products, it has been found that the use of a higher purity hydrogen peroxide, such as hydrogen peroxide sold under the name SUPER D™, a product of FMC (USA), or ULTRACOSMETIC™ grade provided by Solvay Interox Inc. (USA) may provide a composition with an improved stability that justifies the higher initial costs of such peroxides.

The compositions of the present invention include a surfactant system. The surfactant system has one or more surfactants in an amount sufficient to clean the fabric or carpet, yet minimize foaming. Such surfactants may be anionic, cationic, nonionic, zwitterionic, amphoteric, or any combinations thereof.

Preferably, the surfactant system of the present invention has one or more nonionic surfactants, anionic surfactants, amphoteric surfactants, or any combinations thereof.

Examples of suitable nonionic surfactants include, but are not limited to, one or more ethoxylated (EO) alcohol, propoxylated (PO) alcohol, inter-dispersed ethoxylated-propoxylated alcohol, or block ethoxylated-propoxylated alcohol, ethoxylated phenol and propoxylated alkyl phenol, alkyl polyglycoside, alkyl secondary alcohol ethoxylate, and amine oxide, and any combinations thereof. Preferably, the nonionic surfactant is a ethoxylated propoxylated alcohol sold under the tradename BURCO® LAF-6 by Burlington Chemical Company, Inc of Burlington, N.C.; a nonionic/anionic surfactant blend sold under the tradename BURCO-TERGE® DG-40 by Burlington Chemical Company, Inc of Burlington, N.C.; or any combinations thereof.

The one or more nonionic surfactants is present in the compositions of the present invention in an amount about 0.1 wt % to about 6 wt % of the total weight of the composition. Preferably, the one or more nonionic surfactants is present in an amount about 1 wt % to about 5 wt %, and more preferably about 2 wt % to about 4 wt %, of the total weight of the composition.

Examples of suitable amphoteric surfactants include, but are not limited to, one or more sultaines, betaines, and any combinations thereof. Preferably, the amphoteric surfactant is a sultaine, such as an alkylether hydroxypropyl sultaine sold under the tradename BURCO® HCS-989-DF by Burlington Chemical Company, Inc, an alkylether hydroxypropyl sultaine sold under the tradename BURCO® HCS-10S by Burlington Chemical Company, Inc, or any combinations thereof.

The one or more amphoteric surfactants is present in the compositions of the present invention in an amount about 0.1 wt % to about 4 wt % of the total weight of the composition. Preferably, the one or more amphoteric surfactants is present in an amount about 0.2 wt % to about 3 wt %, and more preferably about 0.3 wt % to about 2 wt %, of the total weight of the composition.

Examples of suitable anionic surfactants include, but are not limited to, one or more alkyl sulfates, alkyl sulfonates, alkyl aryl sulfonates, alcohol sulfates and sulfonates, alcohol phosphates and phosphonates, alkali metal or ammonium salts of fatty acids, sulfonated amines, sulfonated amides, fatty sarcosinates, linear alkylated sulfonates, alcohol ether sulfates, secondary alkane sulfonates, or any combinations thereof. Preferably, the anionic surfactant is an alkyl sulfate, alkyl aryl sulfonate, or any combinations thereof.

The one or more anionic surfactants is present in the compositions of the present invention in an amount about 0.01 wt % to about 2 wt % of the total weight of the composition. Preferably, the one or more anionic surfactants is present in an amount about 0.01 wt % to about 1 wt %, and more preferably about 0.01 wt % to about 0.5 wt %, of the total weight of the composition.

The compositions of the present invention may include additional components. Such additional components include, but are not limited to, one or more soil redeposition inhibitors, chelating agent/pH modifiers, preservatives, organic solvents, or any combinations thereof.

The cleaning composition of the present invention may also have one or more soil resists. Suitable soil resists may be, for example, polymeric or copolymeric. Suitable polymeric or copolymeric soil resists include, but are not limited to, one or more polymers derived from styrene-maleic anhydride copolymer resins, monomers of acrylic acids, methacrylic acids, methacrylates, methylmethacrylates, ethyl acrylates, maleic acids, copolymers derived from the above monomers and olefins, or any combinations thereof. Still others may include, but are not limited to, one or more polyvinylpyrrolidones, polyacrylates, modified cellulose polymers, polycarboxylates, vinyl acetate/maleic anhydride copolymer resins, cationic amines, aliphatic quaternary ammonium salts known to have anti-static properties, imidazoline salts, fluoroaliphatic oligomer or polymers, fluorinated hydrocarbon soil resists such as the Zonyl® series from DuPont, fluorinated acrylate copolymers, or any combinations thereof. Preferably, the soil redeposition inhibitor is a sodium polyacrylate sold under the tradename BURCOSPERSE AP LIQUID by Burlington Chemical Company, Inc.

The one or more soil resists is present in the compositions of the present invention in an amount about 0.01 wt % to about 3 wt % of the total weight of the composition. Preferably, the one or more soil resists is present in an amount about 0.1 wt % to about 2 wt %, and more preferably about 0.1 wt % to about 1 wt %, of the total weight of the composition.

The compositions of the present invention may have one or more chelating agent/pH modifiers. Examples of suitable chelating agent/pH modifiers include, but are not limited to, one or more organic diphosphonic acids, one or more inorganic acids, inorganic bases, salts of inorganic acids, organic acids, organic bases, salts of organic acids, phosphorous compounds, or any combinations thereof. Preferably, the chelating agent/pH modifier is 1-hydroxyethylidene-1,1-diphosphonic acid.

The one or more chelating agent/pH modifiers is present in the compositions of the present invention in an amount about 0.01 wt % to about 2 wt % of the total weight of the composition. Preferably, the one or more chelating agent/pH modifiers is present in an amount about 0.1 wt % to about 1 wt %, and more preferably about 0.1 wt % to about 0.6 wt %, of the total weight of the composition.

The compositions of the present invention may include one or more preservatives. Suitable preservatives include, but are not limited to, one or more formaldehyde donors, such as 1-(3-chloroallyl)-3,5,7-azoniaadamantane chloride sold by Dow Chemical Company under the tradename DOWICIL 75; hexahydro-1,3,5-tris(2-hydroxyethyl)-s-triazine sold under the tradename SURCIDE-P; imidazolidinyl urea; DMDM hydantoin; or any combinations thereof. Preferably, the preservative is hexahydro-1,3,5-tris(2-hydroxyethyl)-s-triazine.

The one or more preservatives is present in the compositions of the present invention in an amount about 0.01 wt % to about 1 wt % of the total weight of the composition. Preferably, the one or more preservatives is present in an amount about 0.01 wt % to about 0.5 wt %, and more preferably about 0.01 wt % to about 0.2 wt %, of the total weight of the composition.

Optionally, the compositions of the present invention may include one or more organic solvents. Suitable organic solvents for uses in the present invention include, but are not limited to, one or more hydrocarbons including halogenated hydrocarbons and aromatic hydrocarbons; glycols including ethylene glycols, glycol ethers, propylene glycols, propylene glycol methyl ethers, propylene glycol butyl ethers, dipropylene glycols including dipropylene glycol methyl ethers, tripropylene glycols including tripropylene glycol methyl ethers, diethylene glycol butyl ethers, and glycol ether esters; methanols; ethanols; propanols; isopropanols; n-butanols; sec-butanols; tert-butanols; hexylcellosolves; butylcellosolves; methylcellosolves; esters; ketones; plasticizers; or any combinations thereof.

The compositions of the present invention are aqueous compositions. Preferably, the compositions include water, which is present in an amount about 80 wt % to about 99 wt % of the total weight of the composition. More preferably, the water is present in an amount about 85 wt % to about 98 wt % of the total weight of the composition. Most preferably, the water is present in an amount about 90 wt % to about 97 wt % of the total weight of the composition.

Preferably, the cleaning compositions of the present invention also include one or more enhancing agents. These enhancing agents improve the stability, efficacy, ease, and/or pleasure of use by the end user. The one or more enhancing agents that can be used in the present cleaning compositions include, but are not limited to, one or more fragrances, malodor reducing agents, salts, sugar derivatives, or any combinations thereof.

One or more fragrances may be used in the present cleaning compositions to eliminate the chemical smell inherent with cleaning compositions. Also, the fragrance may mask or eliminate any odors associated with the soiled item to be cleaned.

Suitable fragrances include, but are not limited to, one or more aromatic or aliphatic esters having a molecular weight from about 130 to about 250, aliphatic or aromatic alcohol having a molecular weight from about 90 to about 240, aliphatic ketone having a molecular weight from about 150 to about 260, aromatic ketone having a molecular weight from about 150 to about 270, aromatic and/or aliphatic lactone having a molecular weight from about 130 to about 290, aliphatic aldehyde having a molecular weight from about 140 to about 200, aromatic aldehyde having a molecular weight from about 90 to about 230, aliphatic or aromatic ether having a molecular weight from about 150 to about 270, condensation product of aldehyde and amine having a molecular weight from about 180 to about 320, or any combinations thereof.

When present, the one or more fragrances are present in an amount about 0.001 wt % to about 2 wt % of the total weight of the composition. Preferably, the fragrance is present in an amount about 0.05 wt % to about 1 wt %. The more preferred amount of fragrance is about 0.1 wt % to about 0.5 wt % of the total weight of the composition. The most preferred amount of fragrance is about 0.3 wt %.

One or more malodor reducing agents may be used in the cleaning composition of the present invention. Useful malodor reducing agents include, but are not limited to, one or more cyclodextrins, inorganic and organic acids, metallic salts of inorganic and/or organic acids, enzymes or enzyme systems, metazenes, or any combinations thereof.

The pH range of the cleaning compositions of the present invention is about 3.5 to about 8.5. The more preferred pH range is about 4 to about 7, with the most preferred being about 4.5 to about 5.5. The pH can be adjusted within this range by addition of a stabilizer or a pH modifying agent. Control of the compositional pH is critical as increased pH can cause the degradation of the peroxygen compound.

In addition to controlling the pH of the final composition, it is also important to control the pH of the composition at the point the peroxygen compound is added. Thus, it is preferable to mix the surfactants and other components of the composition first, followed by addition of the stabilizer/pH modifier as needed to provide a suitable pH to the composition, at which time the peroxygen compound can be added. The order of addition may be modified, however, the peroxygen compound is advantageously added at a point after which the pH of the composition will not be above about 9.5, and will preferably not rise above about 7.5.

The following examples disclosing formulas and tests according to the present invention are illustrative only and are not intended to limit the scope of the present invention in any way.

EXAMPLE 1

A composition (Composition A) of the present invention was formed with the following ingredients in amounts expressed as percent by weight (wt %) of the total weight of the composition.

TABLE 1

| Composition A | |
|---|---|
| Ingredient | Wt % Active |
| Water | Q.S. |
| BURCO LAF-6[1] | 2.5 |
| BURCO HCS-989-DF[2] | 1.31 |
| Hydrogen Peroxide | 1 |
| BURCOTERGE DG-40[3] | 0.74 |
| Sodium Polyacrylate | 0.43 |
| 1-Hydroxyethylidene-1,1-disphosphonic Acid | 0.31 |
| Fragrance | 0.3 |
| Hexahydro-1,3,5-tris(2-hydroxyethyl)-s-triazine | 0.08 |

[1]Nonionic Surfactant (alcohol ethoxylate propoxylate) sold by Burlington Chemical Company, Inc. of Burlington, North Carolina.
[2]Amphoteric Surfactant Blend (alkylether hydroxypropyl sultaine) sold by Burlington Chemical Company, Inc. of Burlington, North Carolina.
[3]Anionic/Nonionic Surfactant Blend (nonionic surfactant/fatty alcohol sulfate/glycol ethers/stabilizer) sold by Burlington Chemical Company, Inc. of Burlington, North Carolina.

EXAMPLE 2

A composition (Composition B) of the present invention was formed with the following ingredients in amounts expressed as wt % of the total weight of the composition.

TABLE 2

| Composition B | |
|---|---|
| Ingredient | Wt % Active |
| Water | Q.S. |
| BURCO LAF-6[1] | 2.5 |
| BURCO HCS-10S[4] | 1.25 |
| Hydrogen Peroxide | 1 |
| BURCOTERGE DG-40[3] | 0.74 |
| Sodium Polyacrylate | 0.43 |
| 1-Hydroxyethylidene-1,1-disphosphonic Acid | 0.31 |
| Fragrance | 0.3 |
| Hexahydro-1,3,5-tris(2-hydroxyethyl)-s-triazine | 0.08 |

[1] and [3]See after Table 1
[4]Amphoteric Surfactant Blend (alkylether hydroxypropyl sultaine) sold by Burlington Chemical Company, Inc. of Burlington, North Carolina.

EXAMPLE 3

The following comparative composition (Composition C) was formed with the following ingredients in amounts expressed as wt % of the total weight of the composition.

TABLE 3

| Composition C | |
|---|---|
| Ingredient | Wt % Active |
| Water | Q.S. |
| BURCO LAF-6[1] | 2.5 |
| BURCOTERGE DG-40[3] | 1.96 |
| Hydrogen Peroxide | 1 |
| Sodium Polyacrylate | 0.43 |
| 1-Hydroxyethylidene-1,1-disphosphonic Acid | 0.25 |
| Fragrance | 0.3 |
| Hexahydro-1,3,5-tris(2-hydroxyethyl)-s-triazine | 0.08 |

[1] and [3]See after Table 1

EXAMPLE 4

A composition (Composition D) of the present invention was formed with the following ingredients in amounts expressed as wt % of the total weight of the composition.

TABLE 4

| Composition D | |
|---|---|
| Ingredient | Wt % Active |
| Water | Q.S. |
| BURCO LAF-6[1] | 2.5 |
| BURCO HCS-989-DF[2] | 1.6 |
| Hydrogen Peroxide | 1 |
| BURCOTERGE DG-40[3] | 0.245 |
| Sodium Polyacrylate | 0.43 |
| 1-Hydroxyethylidene-1,1-disphosphonic Acid | 0.31 |
| Fragrance | 0.3 |
| Hexahydro-1,3,5-tris(2-hydroxyethyl)-s-triazine | 0.08 |

[1] and [3]See after Table 1

EXAMPLE 5

In order to quickly assess potential long-term product stability in terms of peroxygen stability, an analytical test method has been developed. This test method was used as an initial screening tool to predict a composition's potential for long-term peroxygen stability. Typical stability studies (various temperature conditions over a number of different time periods) are performed on leading candidates that meet the initial stability and performance criteria.

Hydrogen peroxide containing compositions were subjected to the following preliminary test procedure. Note that all glassware and other materials coming in contact with test solutions should be thoroughly cleaned and passivated prior to use.

The hydrogen peroxide content of each cleaning composition of interest was first acquired. The amount of sample to use in the method was calculated using the following Equation 1:

$$W = \frac{8.5}{S}, \tag{1}$$

wherein W is the weight of sample (in grams) to use and S is the expected % of hydrogen peroxide in the sample. Next, the calculated amount of sample was placed in a vessel, such as a 250 mL Erlenmeyer flask. 50 mL of 25% sulfuric acid solution was added to the vessel. The resulting mixture was then titrated with 0.5 N potassium permanganate solution sufficient to achieve a pink end point that persists for at least 30 seconds, noting the amount of potassium permanganate solution required in milliliters (mL). A duplicate blank determination was performed using 50 mL of 25% sulfuric acid solution (without sample) titrated with 0.5 N potassium permanganate solution as above. Equation 2 was used to determine the initial hydrogen peroxide content in percent of each composition of interest.

$$\%\ \text{Hydrogen Peroxide} = \frac{(V_1 - V_2) \times N \times 1.701}{W}, \tag{2}$$

wherein N is the normality of potassium permanganate solution, $V_1$ is the volume in mL of 0.5 N potassium permanganate required by the sample titration, $V_2$ is the volume in mL of 0.5 N potassium permanganate required by the blank titration, and W is the weight of the sample in grams.

Next, 100.0 mL of sample was added to a vessel, such as a 250 mL Erlenmeyer flask. The sample is then covered and heated at a maintained temperature of 100°-110° C., preferably by covering loosely with a metal foil, such as aluminum foil, and placing in an oven. The sample is heated for four hours, removed from heat, and cooled to room temperature. The sample is transferred to a volumetric vessel, such as a 100 mL volumetric flask. The volume of the sample is re-adjusted to 100 mL with distilled or deionized water. The sample is mixed well. The final concentration of the hydrogen peroxide (%) in the composition after heating is obtained as set forth above. The Percent Hot Stability (Percent $H_2O_2$ Recovery) of the sample composition is determined using Equation 3:

$$\begin{matrix}\text{\% Hot Stability} \\ (\text{\% } H_2O_2\text{Recovery})\end{matrix} = \frac{C_2}{C_1} \times 100, \tag{3}$$

wherein $C_1$ is the initial hydrogen peroxide concentration and $C_2$ is the final hydrogen peroxide concentration.

Using the above procedure and calculations, Compositions A, B, C and D were screened for hydrogen peroxide stability. The results are shown in Table 5.

TABLE 5

| | Hydrogen Peroxide Stability | |
|---|---|---|
| | % $H_2O_2$ Recovery Trial 1 | % $H_2O_2$ Recovery Trial 2 |
| Composition A | 95.0 | 96.9 |
| Composition B | 93.3 | 95.1 |
| Composition C | 91.8 | |
| Composition D | 92.3 | |

Trial 1 was done at lab bench scale and Trial 2 was done at a pilot batch scale. The data from Compositions A and B show that these compositions should be very stable at small and large scale. An acceptable range of % Hydrogen Peroxide Recovery for compositions of the present invention is about 70% to about 100%, preferably about 80% to about 100%, and more preferably about 90% to about 100%.

Compositions that perform favorably under the above stability testing are then considered for more expensive and time-consuming hydrogen peroxide stability testing. This predictor test may also be used to test or validate the use of various other broad classes of components and chemistries in cleaning composition with hydrogen peroxide.

EXAMPLE 6

Based on the percent hydrogen peroxide remaining, the stability of Composition A was determined after two weeks, one month and two months at room temperature (25° C.), 38° C. and 45° C. The stability of Composition B was determined after two weeks at 25° C., 38° C. and 45° C. The samples were also visually evaluated after each temperature condition and after three freeze/thaw (−4° C.) cycles. The results of the stability test are shown in Table 6.

TABLE 6

| | Peroxide Stability Over Time | | | |
|---|---|---|---|---|
| | | Wt % Hydrogen Peroxide per Total Weight of the Composition | | |
| | | 25° C. | 38° C. | 45° C. |
| Composition A | Initial | 1.07 | 1.07 | 1.07 |
| | 2 Weeks | 1.07 | 1.09 | 1.08 |
| | 1 Month | 1.05 | 0.87 | 0.82 |
| | 2 Months | 1.10 | 1.05 | 1.07 |
| Composition B | Initial | 1.10 | 1.10 | 1.10 |
| | 2 Weeks | 1.12 | 1.13 | 1.11 |

The above data demonstrated the excellent peroxygen stability of the composition of the present invention. Visual inspection of the aged samples showed the room temperature samples to be visually acceptable (clear, no sediment). Samples subjected to elevated temperatures (38° C., 45° C.) showed the liquid solution to have two clear layers, which easily became homogeneous upon simple shaking. These samples remained homogeneous upon further aging at room temperature. No sediment was observed in any of the samples. After three cycles of freeze/thaw, the solution remained clear with no visible phase separation or precipitation.

In another embodiment, the present invention includes a method of predicting the amount of foam that will be generated by a composition when used in a steam cleaning machine. A sample of the composition to be tested is combined with deionized water at Room Temperature (RT), such that the weight ratio of the composition to the deionized water is 1:9. Preferably, the weight of the composition to be tested is about 10 grams and the weight of the deionized water is 90 grams. Preferably, the combination is mixed such that the composition and the deionized water are a homogenous mixture. Care should be taken in mixing such that no foam, or as little foam as is possible, is produced at this stage. The combination is performed in, or the resulting combination is placed in, a vessel, such as a 500 ml graduated cylinder. The vessel includes a way of measuring the starting volume of the combination and a way to seal the opening to the vessel, such as a stopper. The vessel is then sealed such that the combination is retained within the vessel when the vessel is inverted. The vessel is subjected to an inversion cycle of turning the vessel upside down and then right side up. The vessel is subjected to ten inversion cycles. Immediately after the 10th inversion cycle, the vessel is placed on a flat surface and the volume indicated by the top of the largest mass of foam is recorded. This represents the combination's initial foam height ($F_0$). The vessel with foam is allowed to sit undisturbed for 5 minutes, and the foam height is recorded again. The reading after 5 minutes represents the amount of foam decay ($F_5$). The test is repeated 5 times and the average value, $F_A$, for both $F_0$ and $F_5$ is calculated according to Equation 4.

$$F_A=(F_0+F_5)/2 \tag{4}$$

The average $F_A$ value is put into the Equation 5 to obtain the MR Foam Value:

$$\frac{F_A - 100}{10} = MR \text{ Foam Value.} \tag{5}$$

The MR Foam Value is given a foam rating according to the scale in Table 7:

TABLE 7

MR Foam Value and Foam Rating

| MR Foam Value | Foam Rating |
|---|---|
| 0-11 | Most Acceptable/will pass outside testing |
| >11-14 | More Acceptable/more likely to pass outside testing |
| >14-16 | Acceptable/likely pass outside testing |
| >16-17 | Borderline pass/fail |
| >17 | likely to fail |

EXAMPLE 7

Foam tests were conducted on the Compositions A to C as set forth in Examples 1 to 3 using the predictor test described above. This predictor test was also performed on two existing commercially available products that do not contain any peroxygen compound: Bissell Fiber Cleansing (Composition X) and Resolve For Steam Machines (Composition Y). Specifically, a 10 gram sample of the composition to be tested was added to 90 grams of deionized water at RT in a beaker and slowly mixed. The solution was then slowly poured into a 500 ml graduated cylinder outfitted with a stopper. The stopper of the graduated cylinder was then used to securely seal the vessel. The cylinder was turned upside down and right side up for a total of 10 times. Immediately after the 10th inversion is cycle, the cylinder was placed on a flat surface and the graduation mark at the top of the largest mass of foam was recorded to obtain the initial foam height ($F_0$). The cylinder with foam was allowed to sit undisturbed for 5 minutes, and the foam height was read again to obtain amount of foam decay ($F_5$). The test was repeated 5 times for each composition and the average value, $F_A$, for both $F_0$ and $F_5$ was calculated. The average $F_A$ value was used to calculate the MR Foam Value as set forth above.

Results of lab testing using the above described test method are shown in Tables 8, and 9.

TABLE 8

Foam Predictor Test Results for Compositions A, B, C, X, and Y

| | Composition | | | | | | | | | | | |
|---|---|---|---|---|---|---|---|---|---|---|---|---|
| | A | | B | | C | | D | | X | | Y | |
| Trial | $F_0$ | $F_5$ | $F_0$ | $F_5$ | $F_0$ | $F_5$ | $F_0$ | $F_5$ | $F_0$ | $F_5$ | $F_0$ | $F_5$ |
| 1 | 230 | 175 | 235 | 215 | 250 | 165 | 230 | 165 | 200 | 100 | 275 | 235 |
| 2 | 230 | 200 | 250 | 195 | 290 | 170 | 250 | 160 | 200 | 100 | 265 | 220 |
| 3 | 235 | 190 | 235 | 220 | 270 | 175 | 220 | 160 | 200 | 100 | 245 | 210 |
| 4 | 250 | 220 | 230 | 180 | 275 | 175 | 225 | 165 | 210 | 100 | 270 | 240 |
| 5 | 225 | 195 | 235 | 220 | 275 | 180 | 220 | 160 | 200 | 105 | 265 | 210 |
| Ave. | 234 | 196 | 237 | 206 | 272 | 173 | 229 | 162 | 202 | 101 | 264 | 223 |

TABLE 9

Summary of MR Foam Value

| | Average $F_0$ | Average $F_5$ | MR Foam Value |
|---|---|---|---|
| Bissell Fiber Cleansing (X) | 202 | 101 | 10.2 |
| Resolve For Steam Machines (Y) | 264 | 223 | 16.4 |
| Composition A | 234 | 196 | 13.4 |
| Composition B | 237 | 206 | 13.7 |
| Composition C | 272 | 173 | 17.2 |
| Composition D | 229 | 162 | 12.9 |

EXAMPLE 8

Foam testing of Compositions A, C, X, and Y was performed at an outside testing facility (Professional Testing Laboratory, Inc.). Two popular brands of steam machines (Bissell and Hoover) were chosen for use in the test. The two models were Bissell's ProHeat Clearview 1699 and the Hoover SteamVac Deluxe (F5872-900).

For the Bissell machine, each composition was added directly into the machine and the dosage was determined by the setting on the machine (Normal Setting, High Traffic Setting). For this testing the High Traffic setting was used. This translates to ~11-12 oz. of product per gallon of hot tap water (120° F.) and represents typical consumer usage for this popular machine. Compositions A and C are preferably used at a dilution at 4 oz. per gallon of hot tap water. At ~11-12 oz. per gallon of hot tap water, this level of composition was approximately 3 times the preferred amount of Compositions A and C. Even if a composition is a low foamer at the normal dosage level, it can experience foaming problems under this usage condition, which may be typical for this popular machine. For this machine, too much foam generation could result in foam flowing out of the bottom of the machine onto the user's carpet and creating a mess on the carpet that would need to be cleaned up. Furthermore, given the construction of the Bissell machine, a high foaming product could result in foam being sucked into the porthole that leads to the motor housing. If this occurs damage to the machine could result. Use of the Bissell machine at the High Traffic setting represents the most rigorous conditions for foam testing.

For the Hoover machine, the recommended composition concentration for Composition X is 5 oz. per gallon and Composition Y is 4 oz. per gallon of hot tap water (120° F.). Compositions A and C were used at a concentration of 4 oz.

per gallon of hot tap water. The Hoover machine has a float device in the dirty water (extraction) tank that will turn the machine off if the foam level gets too high. Although this prevents foam from overflowing onto the carpet or back into the machine itself, a heavy foaming product will cause inconvenience for the consumer since they will have to empty the partially filled collection tank more often due to the foam build up.

The foam test at PTL (Professional Testing Laboratory, Inc.) is known as the Safety Test for Steam Machines. A 100% Nylon carpet swatch (10⅜"×39⅜") with Scotchgard Soil & Stain treatment was placed into a template of the same material. This was then placed on a conveyor apparatus capable of maintaining a specified speed (1 ft./sec.) in both forward and reverse directions. The steam machine was secured to the template, and the composition and test conditions were set as indicated above. For this testing, the recovery tank of the steam machine was rated for foam build up after both 10 and 20 cleaning cycles. A cleaning cycle was equivalent to 2 wet passes followed by 4 dry passes. The foam rating scale utilized for these evaluations were none, slight, moderate, heavy or N.T. (Not Tested). N.T. refers to the situation where the foaming was so heavy that the test had to be discontinued before the proper number of cleaning cycles could be completed. A product with a rating of N.T. is considered unacceptable.

Results of the foam testing are shown in Table 10.

TABLE 10

Foam Testing Results

| | Bissell F.C.* | Resolve Steam** | Comp. A*** | Comp. C*** |
|---|---|---|---|---|
| Bissell Machine (10 Cycles) | Slight | Moderate/Heavy | Moderate | Heavy |
| Bissell Machine (20 Cycles) | Slight | Heavy/N.T. | Heavy | N.T. |
| Hoover Machine (10 Cycles) | Slight | Moderate | Slight | Heavy |
| Hoover Machine (20 Cycles) | Slight | Moderate | Slight | N.T. |

*Bissell Fiber Cleansing Formulation was tested at 75° F.
**Resolve for Steam Machines was tested at both 75° F. and 120° F.
***Compositions A and C were tested at 120° F.

Comparing results from the in-lab predictor test (MR Foam Value) with the results obtained using the outside testing facility, it is clear that the predictor test shows the four compositions to have values/ratings similar to what were produced in the outside testing. Thus, this predictor test method (MR Foam Value) can be used to screen formulations for acceptable foam profiles. These and other composition testing have shown statistically that the predictor test is a reliable measure of actual foaming performance in steam cleaning machines.

EXAMPLE 9

Testing was performed at a testing laboratory to demonstrate the ability of the composition of Example 1 to remove common heavy traffic particulate soil typically found on rugs and carpets. A cut pile nylon carpet (25418 Spotlite) was subjected to an accelerated soiling process whereby the degree of soiling was measured or assessed by comparing the change in color between the soiled carpet swatch and the original pile yarn floor covering. Color differences were measured both visually (MTCC Gray Scale) as well as by a measurement device (0/45° Spectrophotometer). The soiled carpet swatch was then cleaned using one of two steam machines (Bissell ProHeat Clearview 1699 or Hoover StreamVac Deluxe F5872-900). Cleaning conditions included use of hot tap water at 120° F. The Bissell machine was dosed at 4 oz. Per gallon of water. For the cleaning procedure, the test product was placed in the appropriate steam machine, and the soiled carpet swatch was cleaned using hot water extraction, which consisted of two detergent strokes followed by four dry strokes. Results of this study are shown below.

| Initial Soiled Carpet | After Cleaning |
|---|---|
| Bissell Machine | |
| 2.5 | 3.5 |
| Hoover Machine | |
| 2.5 | 3.0 |

Gray Scale Rating
5 - No Change
4 - Slight Change
3 - Noticeable Change
2 - Considerable Change
1 - Severe Change Results of this study clearly show the effectiveness of this invention in removing heavy traffic particulate soil. It should be noted that given the rigorousness of this procedure as well as the difficulty of removing the type of soil that was used, small incremental improvements of 0.5 and 1.0 indicate good cleaning effectiveness.

EXAMPLE 10

While cleaning of a carpet is an important performance attribute of any cleaning composition, it is equally important that most, if not all, of the soil as well as any cleaning components from the cleaning solution be removed from the carpet surface. Cleaning components not fully removed either by water extraction or by vacuuming could potentially be sites on the carpet that have a propensity to soil or resoil faster. Thus, leading to the carpet appearing duller or less clean over a shorter period of time. A resoiling study was performed at an outside testing facility to evaluate the resoiling propensity of our invention versus a leading steam machine cleaner. The Bissell ProHeat Clearview 1699 machine was used at the High Traffic setting because at that setting the machine will deliver a much higher concentration of product to the carpet during the cleaning operation than what would normally be delivered using the recommended dosage level. The temperature of the hot tap water used was 120° F. Similar to the cleaning study, the cut pile nylon carpet (25418 Spotlite) used was soiled using the same accelerated soiling procedure.

For this study, the soiled carpet swatches undergo three cleaning cycles. At the end of the cleaning cycles, the carpet swatches are subjected to the soiling process again. These treated swatches are then compared and evaluated versus swatches that were soiled during the original soiling process, but were not treated by any cleaning product. The degree of soiling was measured and assessed by both a measuring device as well as visually using the Gray Scale. The visual assessment results are shown below.

| Initial Soiled Carpet | After Cleaning/Resoiling |
|---|---|
| Resolve For Steam Machines | |
| 2.5 | 1.5 |
| Compound A | |
| 2.5 | 2.0 |

Gray Scale Rating
5 - No Change
4 - Slight Change
3 - Noticeable Change
2 - Considerable Change
1 - Severe Change Results from this study clearly indicate that the resoiling profile of our invention is at least comparable to that of a leading steam machine cleaning brand and is at an acceptable level for consumer use.

EXAMPLE 11

An important area of concern was the potential aggressiveness that a peroxygen-containing formulation might have towards the various machine components that might be exposed to the solution. To determine machine component safety in the presence of our selected formulation(s), a testing protocol was developed to quickly ascertain the effect of the solution on the machine components tested.

Popular high end and low end machines (in terms of cost) from the top three machine manufacturing companies (Bissell, Hoover and Dirt Devil) were evaluated. Steam machines tested included the following:

Bissell ProHeat Pro-Tech (Model #7920)

Bissell 1950 Series Quik Steamer (Model #1950-6)

Hoover SteamVac Ultra (Model F5872-900)

Dirt Devil Featherlite Deluxe Carpet Shampooer CE6100

(Note that other steam machines from the same manufacturer would be covered by the above due to the fact that they are made from essentially the same components compositionally. For example, the Bissell ProHeat Pro-Tech machine utilizes essentially the same components as the Bissell ProHeat Clearview Plus 1699 series. Another example is the Hoover SteamVac Deep Cleaner F5826-900 whose machine parts are near identical to those of the Hoover SteamVac Ultra F5872-900.)

Each steam machine was examined thoroughly to determine the wash solution flow path, both as it exhausts onto the carpet as well as its movement through the machine as it is extracted back off the carpet. Final examination of the solution flow path yielded the identity of all machine components that would come in contact with the wash solution. These machine components were removed and cut into suitably sized pieces for testing using the Boil Test protocol. Each steam machine yielded the following number of components to test.

| Steam Machines | # of Components |
|---|---|
| Bissell ProHeat Pro-Tech (Model #7920) | 21 |
| Bissell 1950 Series Quik Steamer (Model #1950-6) | 10 |
| Hoover SteamVac Ultra (Model F5872-900) | 13 |
| Dirt Devil Featherlite Deluxe Carpet Shampooer CE61 | 18 |

Each representative machine component sample was placed in an appropriate sized beaker containing a designated amount of 100% solution concentrate. Test solutions consisted of the product to be tested as well as a number of control solutions. In each case, Resolve For Steam Machines Concentrate was used as a control along with tap water. Another control used was the steam machine manufacturer's own recommended cleaning solution (e.g., Bissell Fiber Cleansing Formula for Bissell machine components, Hoover SteamVac Carpet/Upholstery Detergent for Hoover machine components and Dirt Devil Carpet & Rug Shampoo for Dirt Devil machine components). The beaker containing the component sample was then boiled for 30 minutes. Upon completion of the boiling process, samples were removed from their respective solutions, allowed to cool to room temperature then dried. Samples were then compared to one another as well as to a final control reference sample, which was represented by an untreated machine component piece.

Results of this study were based on a thorough examination of the machine component pieces. Pieces were compared to the initial state of the component before boiling, then to the final state of the part after boiling. Comparison of each component piece to its respective controls was extremely important to help determine the severity of the change, if a change occurred at all.

All designated components of each machine were evaluated under high standard conditions (100% solution concentration, 30 minutes of boiling). Thorough visual examination of each component showed that none of the individual machine components were badly affected by the test formulations (Composition A and Composition B) described in this invention. Overall, the two test formulations compared favorably to the control references used in the evaluations.

While the present invention has been described with reference to one or more exemplary embodiments, it will be understood by those skilled in the art that various changes may be made and equivalents may be substituted for elements thereof without departing from the scope of the present invention. In addition, many modifications may be made to adapt a particular situation or material to the teachings of the disclosure without departing from the scope thereof. Therefore, it is intended that the present invention not be limited to the particular embodiment(s) disclosed as the best mode contemplated for carrying out this invention, but that the invention will include all embodiments falling within the scope of the claims.

What is claimed is:

1. An aqueous low-foaming cleaning composition comprising:

about 0.1 wt % to about 6 wt % of a peroxygen compound;

a surfactant system present in an amount of 2.3 wt % to about 6 wt % based on the total weight of the composition, the surfactant system comprising:

one or more nonionic surfactants present in an amount of 2 wt % to about 4 wt % based on the total weight of the composition, and one or more amphoteric surfactants present in an amount of 0.3 wt % to about 2 wt % based on the total weight of the composition, wherein said amphoteric surfactants are selected from the group consisting of one or more sultaines, betaines, and any combinations thereof; and one or more preservatives selected from the group consisting of one or more formaldehyde donors, wherein said composition has a MR foam value of less than 16, and wherein said composition is effective and safe for use in cleaning carpets and fabrics with a steam cleaning machine.

2. The composition of claim 1, wherein said composition has a MR foam value of less than 14.

3. The composition of claim 1, wherein said peroxygen compound is selected from the group consisting of hydrogen peroxide and T-butyl-hydroperoxide.

4. The composition of claim 1, wherein said peroxygen compound is present in an amount about 0.5 wt % to about 2 wt % of the total weight of the composition.

5. The composition of claim 1, further comprising one or more anionic surfactants.

6. The composition of claim 1, wherein said one or more nonionic surfactants are selected from a group consisting of one or more ethoxylated (EO) alcohol, propoxylated (PO) alcohol, inter-dispersed ethoxylated-propoxylated alcohol, or block ethoxylated-propoxylated alcohol; ethoxylated alkyl phenol, propoxylated alkyl phenol, alkyl polyglycoside, alkyl secondary alcohol ethoxylate, amine oxide, and any combinations thereof.

7. The composition of claim 5, wherein said one or more anionic surfactants are selected from the group consisting of one or more alkyl sulfates, alkyl sulfonates, alkyl aryl sulfonates, alcohol sulfates and sulfonates, alcohol phosphates and phosphonates, alkali metal or ammonium salts of fatty acids, sulfonated amines, sulfonated amides, fatty sarcosinates, linear alkylated sulfonates, alcohol ether sulfates, secondary alkane sulfonates, and any combinations thereof.

8. The composition of claim 5, wherein said anionic surfactant is present in an amount about 0.01 wt % to about 2 wt % of the total weight of the composition.

9. The composition of claim 1, further comprising one or more soil resists, chelating agent/pH modifiers, preservatives, organic solvents, fragrances or any combination thereof.

10. The composition of claim 9, wherein said one or more soil resists are present, and are selected from the group consisting of styrene-maleic anhydride copolymer resins, monomers and copolymers of acrylic acids, methacrylic acids, methacrylates, methylmethacrylates, ethyl acrylates, maleic acids, polyvinylpyrrolidones, polyacrylates, modified cellulose polymers, polycarboxylates, vinyl acetate/maleic anhydride copolymer resins, cationic amines, aliphatic quaternary ammonium salts known to have anti-static properties, imidazoline salts, fluoroaliphatic oligomer or polymers, fluorinated hydrocarbon soil resists and any combinations thereof.

11. The composition of claim 9, wherein said one or more soil resists are present in an amount about 0.01 wt % to about 3 wt % of the total weight of the composition.

12. The composition of claim 9, wherein said one or more chelating agents/pH modifiers are present, and are selected from the group consisting of one or more organic diphosphonic acids, one or more inorganic acids, inorganic bases, salts of inorganic acids, organic acids, organic bases, salts of organic acids, phosphorous compounds, and any combinations thereof.

13. The composition of claim 12, wherein said one or more chelating agents/pH modifiers is present in an amount about 0.01 wt % to about 2 wt % of the total weight of the composition.

14. The composition of claim 1, wherein said one or more preservatives are present in an amount about 0.01 wt % to about 1 wt % of the total weight of the composition.

15. The composition of claim 9, wherein said one or more organic solvents are present, and are selected from the group consisting of one or more hydrocarbons including halogenated hydrocarbons and aromatic hydrocarbons; glycols including ethylene glycols, glycol ethers, propylene glycols, propylene glycol methyl ethers, propylene glycol butyl ethers, dipropylene glycols including dipropylene glycol methyl ethers, tripropylene glycols including tripropylene glycol methyl ethers, diethylene glycol butyl ethers, and glycol ether esters; methanols; ethanols; propanols; isopropanols; n-butanols; sec-butanols; tert-butanols; hexylcellosolves; butylcellosolves; methylcellosolves; esters; ketones; plasticizers; and any combinations thereof.

16. The composition of claim 1, further comprising water in an amount about 80 wt % to about 99 wt % of the total weight of said composition.

17. The composition of claim 1 further comprising one or more enhancing agents.

18. The composition of claim 17, wherein said one or more enhancing agents are selected from the group consisting of one or more fragrances, malodor reducing agents, salts, sugar derivatives, and any combinations thereof.

19. The composition of claim 18, wherein said one or more fragrances are present, and are selected from the group consisting of one or more aromatic or aliphatic esters having a molecular weight from about 130 to about 250, aliphatic or aromatic alcohol having a molecular weight from about 90 to about 240, aliphatic ketone having a molecular weight from about 150 to about 260, aromatic ketone having a molecular weight from about 150 to about 270, aromatic and/or aliphatic lactone having a molecular weight from about 130 to about 290, aliphatic aldehyde having a molecular weight from about 140 to about 200, aromatic aldehyde having a molecular weight from about 90 to about 230, aliphatic or aromatic ether having a molecular weight from about 150 to about 270, condensation product of aldehyde and amine having a molecular weight from about 180 to about 320, and any combinations thereof.

20. The composition of claim 19, wherein said one or more fragrances are present in an amount about 0.001 wt % to about 2 wt % of the total weight of the composition.

21. The composition of claim 18, wherein said one or more malodor reducing agents are present, and are selected from the group consisting of one or more cyclodextrins, inorganic and organic acids, metallic salts of inorganic and/or organic acids, enzymes or enzyme systems, metazenes, and any combinations thereof.

22. The composition of claim 1, wherein said composition has a pH about 3.5 to about 8.5.

23. The composition of claim 1, wherein said composition is a steam cleaning composition.

24. An aqueous low-foaming cleaning composition comprising approximately, by weight:

a surfactant system present in an amount of 2.3 wt % to about 6 wt % based on the total weight of the composition, the surfactant system comprising:

one or more nonionic surfactants present in an amount of 2 wt % to about 4 wt % based on the total weight of the composition, and one or more amphoteric surfactants present in an amount of 0.3 wt % to about 2 wt % based on the total weight of the composition, wherein said amphoteric surfactants are selected from the group consisting of one or more sultaines, betaines, and any combinations thereof;

0.01% to 3.0% of soil resist;

0.01% to 2.0% of chelating agents/pH modifiers;

about 0.5 wt % to about 2 wt % of a peroxygen compound; and about 0.01 wt % to about 1 wt % of one or more formaldehyde donor preservatives, wherein said composition is effective and safe for use in cleaning carpets and fabrics with a steam cleaning machine.

25. The composition of claim 24, wherein said composition has a MR foam value of less than 16.

26. The composition of claim 1, wherein said one or more formaldehyde donors is selected from the group consisting of 1-(3-chloroallyl)-3,5,7-azoniaadamantane chloride, hexahydro-1,3,5-tris(2-hydroxyethyl)-s-triazine, imidazolidinyl urea, DMDM hydantoin, and any combinations thereof.

27. The composition of claim 1, wherein said amphoteric surfactant is one or more sultaines.

28. The composition of claim 24, wherein said amphoteric surfactant is one or more sultaines.

29. The composition of claim 27, wherein said one or more sultaines are one or more alkylether hydroxypropyl sultaines.

30. The composition of claim 27, wherein said one or more sultaines are one or more alkylether hydroxypropyl sultaines.

* * * * *